US011114070B2

(12) United States Patent
Langberg

(10) Patent No.: US 11,114,070 B2
(45) Date of Patent: Sep. 7, 2021

(54) ATTACHABLE ACCESSORY FOR CHANGING THE TIMBRE OF A STRINGED INSTRUMENT

(71) Applicant: Jonathan Langberg, Stow, MA (US)

(72) Inventor: Jonathan Langberg, Stow, MA (US)

( * ) Notice: Subject to any disclaimer, the term of this patent is extended or adjusted under 35 U.S.C. 154(b) by 521 days.

(21) Appl. No.: 15/516,386

(22) PCT Filed: Oct. 6, 2015

(86) PCT No.: PCT/US2015/054147

§ 371 (c)(1),
(2) Date: Apr. 1, 2017

(87) PCT Pub. No.: WO2016/057460

PCT Pub. Date: Apr. 14, 2016

(65) Prior Publication Data

US 2018/0233117 A1 Aug. 16, 2018

Related U.S. Application Data

(60) Provisional application No. 62/061,525, filed on Oct. 8, 2014, provisional application No. 62/102,043, filed on Jan. 11, 2015.

(51) Int. Cl.

| | |
|---|---|
| ***G10D 3/046*** | (2020.01) |
| ***G10D 1/08*** | (2006.01) |
| ***G10D 3/00*** | (2020.01) |

(52) U.S. Cl.

CPC ..... *G10D 3/046* (2013.01); *G10D 1/08* (2013.01); *G10D 3/00* (2013.01)

(58) Field of Classification Search

CPC ..... G10D 3/046; G10D 1/08; G10D 3/00
USPC ..... 84/310
See application file for complete search history.

(56) References Cited

U.S. PATENT DOCUMENTS

| | | | | |
|---|---|---|---|---|
| 3,933,077 | A | 1/1976 | Dunlop | |
| 4,281,576 | A | 8/1981 | Fender | |
| D373,136 | S | 8/1996 | Goto | |
| 5,567,895 | A * | 10/1996 | Aspri | G10D 3/02 84/294 |
| 5,847,298 | A | 12/1998 | Adams | |
| 5,945,615 | A | 8/1999 | Rose | |
| 6,133,515 | A | 10/2000 | Hoshino | |
| 6,870,083 | B2 | 3/2005 | Turner | |

(Continued)

*Primary Examiner* — Jianchun Qin
(74) *Attorney, Agent, or Firm* — Nelson Mullins Riley & Scarborough LLP; Anthony A. Laurentano

(57) ABSTRACT

An accessory for changing the timbre of a stringed instrument is provided, comprising a body having a vertical opening and a horizontal slot formed in the bottom surface from one edge into the vertical opening; an adjustment rod within the horizontal slot; and a dampener within the vertical opening associated with at least one string of the stringed instrument to which the accessory is attached. The adjustment rod has an upwardly angled inner end within the vertical opening in the body. The dampener comprises a dampener body; a soft fabric covering a top surface; and a bottom surface having a horizontal groove with a downwardly angled top surface matching the angle of the angle of the adjustment rod. Moving the adjustment rod inwardly moves the dampener upward and applies pressure to the string; moving the adjustment rod outwardly moves the dampener downward and reduces the pressure on the string.

17 Claims, 7 Drawing Sheets

(56) References Cited

U.S. PATENT DOCUMENTS

| | | | | |
|---|---|---|---|---|
| 6,875,910 | B2 | 4/2005 | Naimish | |
| 6,891,094 | B2 | 5/2005 | McCabe | |
| 7,279,626 | B2 | 10/2007 | Draper et al. | |
| 7,868,235 | B2 | 1/2011 | Medas | |
| 8,525,008 | B2 | 9/2013 | Babiez | |
| 8,618,386 | B2 | 12/2013 | Sophos | |
| 2004/0050236 | A1 | 3/2004 | Geiger | |
| 2006/0042452 | A1* | 3/2006 | Brown | G10D 3/053 84/455 |
| 2013/0276612 | A1 | 10/2013 | Kosharek | |

* cited by examiner

ATTACHABLE ACCESSORY FOR CHANGING THE TIMBRE OF A STRINGED INSTRUMENT

RELATED APPLICATION DATA

The present application is related to commonly-assigned U.S. Application Ser. No. 62/061,525 entitled ATTACHABLE GUITAR ACCESSORY FOR PRODUCING THE SOUND OF A BANJO, filed on Oct. 8, 2014, and U.S. Application Ser. No. 62/102,043 entitled ATTACHABLE GUITAR ACCESSORY FOR PRODUCING THE SOUND OF A BANJO, filed on Jan. 11, 2015, which applications are incorporated herein by reference in their entireties.

TECHNICAL FIELD

The present invention relates to musical devices and, in particular, to guitar accessories.

BACKGROUND ART

The banjo instrument has been around since the 1800's and has grown to be a very popular instrument, used in many different genres, such as bluegrass, country, and folk. However, there are many guitar players who do not play the banjo, and though some may have the desire to, they may feel intimidated by the differences between the two instruments or do not have the means or time to purchase and learn another separate instrument.

SUMMARY OF THE INVENTION

The present invention provides an attachable accessory for changing the timbre of a stringed instrument. The accessory comprises a body having a first vertical opening formed from a top surface through to a bottom surface and further having a first horizontal slot formed in the bottom surface from one edge of the body into the first vertical opening, the bottom surface being attachable to a stringed instrument under a first string; a first adjustment rod within the first horizontal slot; and a first dampener within the first vertical opening and associated with the first string of the stringed instrument to which the accessory is attached. The first adjustment rod comprises a handle at an outer end extending outside the first slot and an upwardly angled inner end within the first vertical opening in the body. The first dampener comprises a first dampener body; a soft fabric covering a top surface of the first dampener body; and a bottom surface having a horizontal groove with a downwardly angled top surface, the angle of the groove corresponding to the angle of the first adjustment slider. When the first adjustment rod is pushed inwardly, the first dampener moves upward in the first vertical opening whereby the soft fabric applies pressure to the first string of the instrument and when the first adjustment rod is pulled outwardly, the first dampener moves downward in the first vertical opening whereby the pressure on the first string is reduced.

The present invention also provides a method for changing the timbre of a stringed instrument. The method comprises attaching a bottom surface of an accessory body to a stringed instrument under the strings, the accessory body having a plurality of dampeners and a like plurality of adjustment rods, each dampener associated with at least one string and each adjustment rod associated with a corresponding one of the plurality of dampeners; moving an adjustment rod inwardly to move the associated dampener upward to increase pressure against the at least one associated string; and moving the adjustment rod outwardly to move the associated dampener downward to decrease the pressure against the at least one associated string.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Embodiments of the accessory device of the present invention change the timbre of stringed instruments. The embodiment described and illustrated herein emulates a banjo sound on a guitar naturally, without using digital effects, which fall drastically short in simulating a banjo on a guitar. Additionally, a guitar player does not need to buy and learn a separate instrument to produce a banjo sound. Although using the instrument accessory of the present invention on an electric guitar yields the best banjo sound, the device may also be mounted to an acoustic guitar. The resulting sound is similar to the sound of a sitar or koto. As will be appreciated, embodiments of the stringed instrument accessory may be mounted onto any stringed instrument to modify the instrument's timbre.

Figure 1:
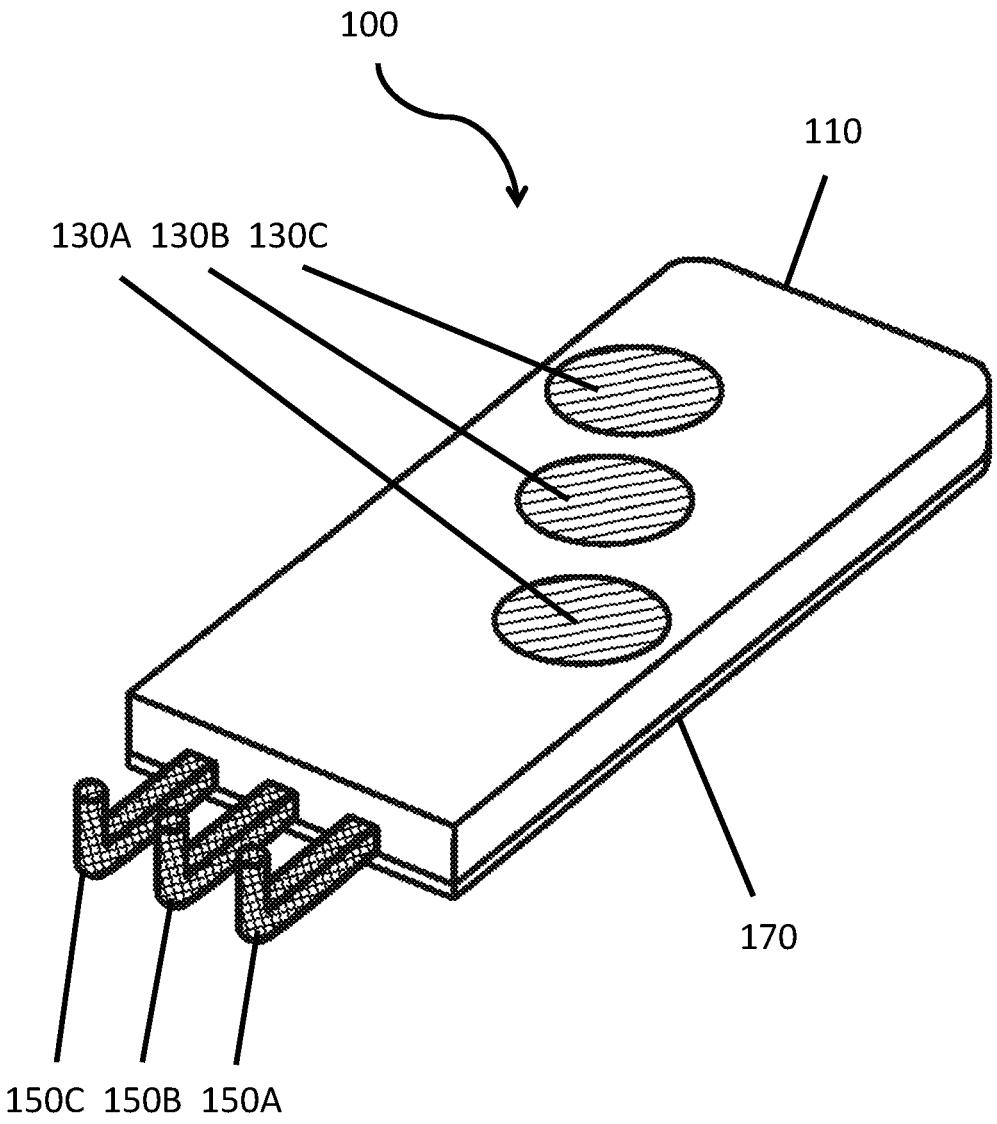
FIG. 1 illustrates a perspective view of an embodiment of an accessory for a stringed instrument of the present invention.
Figure 2:
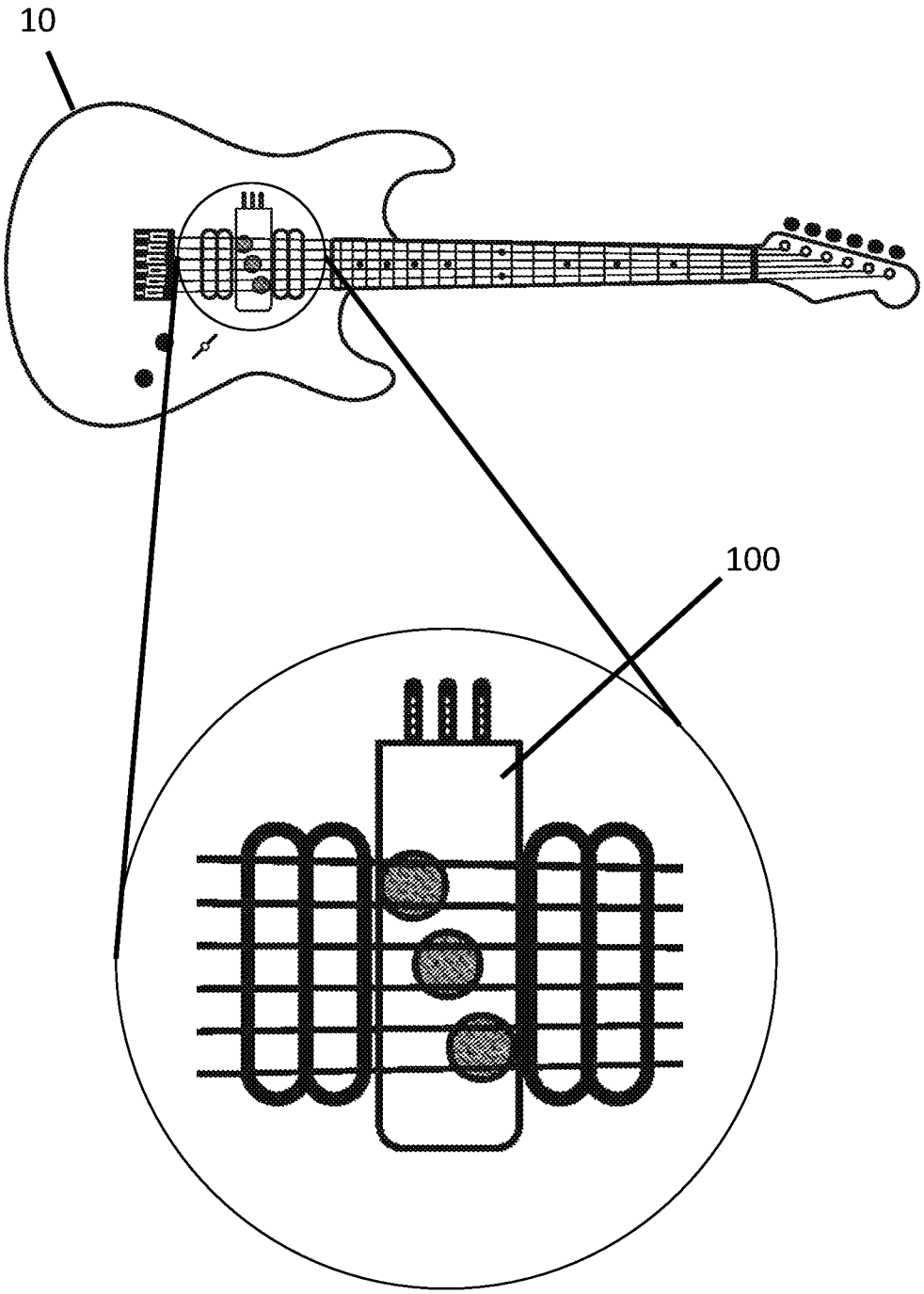
FIG. 2 illustrates the accessory of FIG. 1 mounted on a guitar.

FIG. 1 illustrates a perspective view of an embodiment of an accessory device 100 for a six-stringed instrument. The illustrated device 100 may be removably attached to an electric or acoustic guitar although, as noted above, modifications may be made to accommodate other stringed instruments, such as a four-string bass guitar or violin, for example. The device 100 includes a body or housing 110, a set of staggered dampeners 130A, 130B, 130C (collectively 130), a corresponding set of adjustment rods 150A, 150B, 150C (collectively 150), each adjustment rod 150 associated with one of the dampeners 130, and material 170 for mounting the device 100 onto the surface of a guitar. The device 100 shown in the FIGs. is designed to be attached to the body of a six-string guitar 10 under the strings (FIG. 2). Thus, the device 100 has three dampeners 130, each dampening two adjacent strings, and three adjustment rods 150, one for each dampener. However, the device 100 may be made with more or fewer dampeners 130 and corresponding adjustment rods 150, depending on the number of strings on the instrument to which it will be attached. For example, the device 100 may have the same number of dampeners 130 and adjustment rods 150 as there are strings to dampen each string individually or may have just a single dampener 130 and adjustment rod 150 to dampen all of the strings together. Having one dampener 130 and adjustment rod for every two strings is a convenient compromise between complexity and precision tuning. The two adjacent strings that each dampener 130 affects in the illustrated device 100 are similar enough in diameter and, therefore, distance from the surface of the guitar to make it convenient to tune each two adjacent strings together and obtain a synchronous timbre.

For a typical electric guitar, the body 110 may be approximately 3.75 inches long, approximately 1.375 inches wide, and approximately 0.25 inches thick. The body 110 may be made from any hard material, including aluminum or plastic, such as Delrin® or Plexiglas®. The adjustment rods 150 may be made from a similar material although it is preferable that they be made from a ferromagnetic material.

Figure 3:
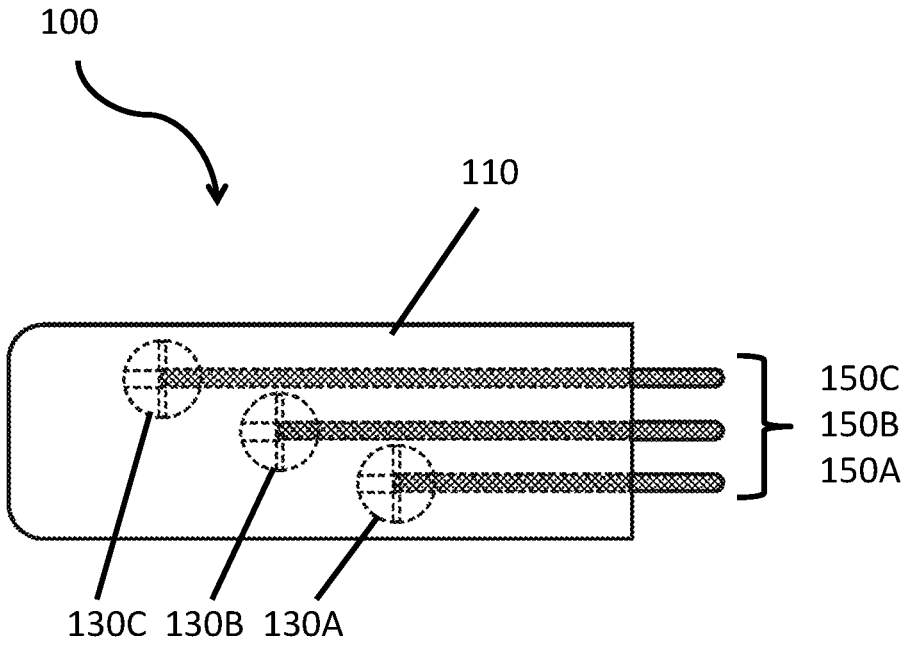
FIG. 3 is a bottom view of the accessory of FIG. 1.
Figure 4:
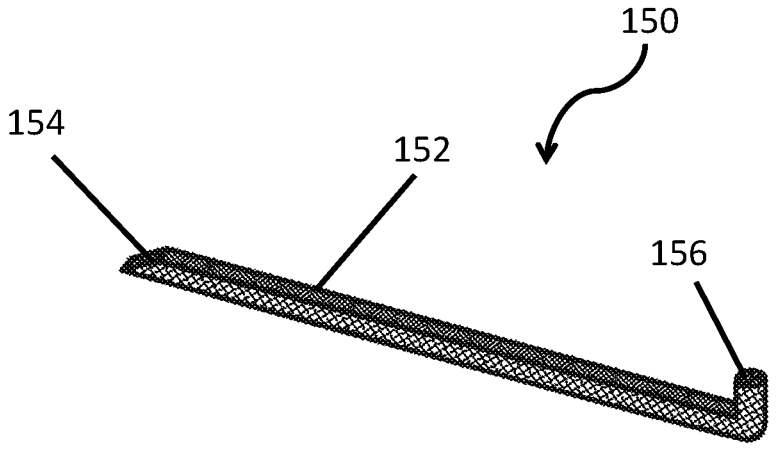
FIG. 4 illustrates an embodiment of an adjustment rod used with the accessory of FIG. 1.
Figure 5A:
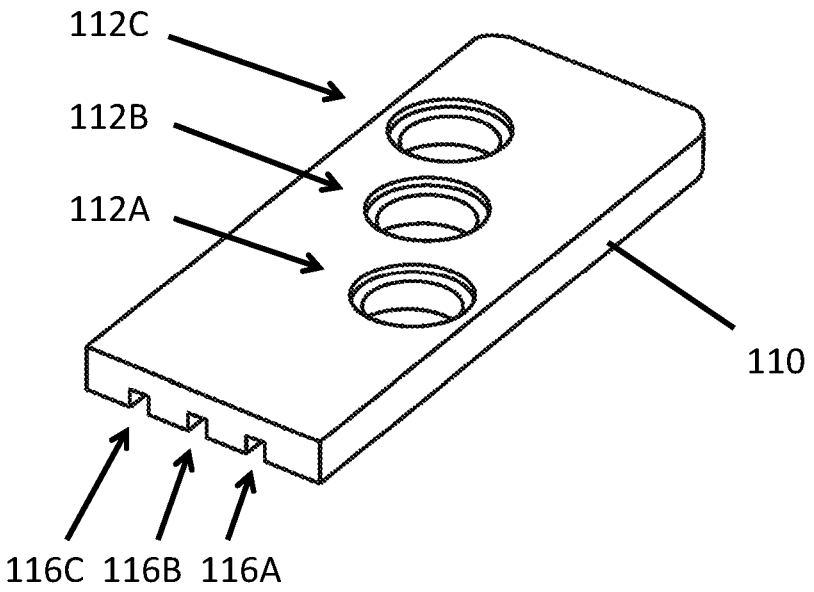
FIG. 5A is a top perspective view of an embodiment of the body of the accessory of FIG. 1.
Figures 5B, 5C:
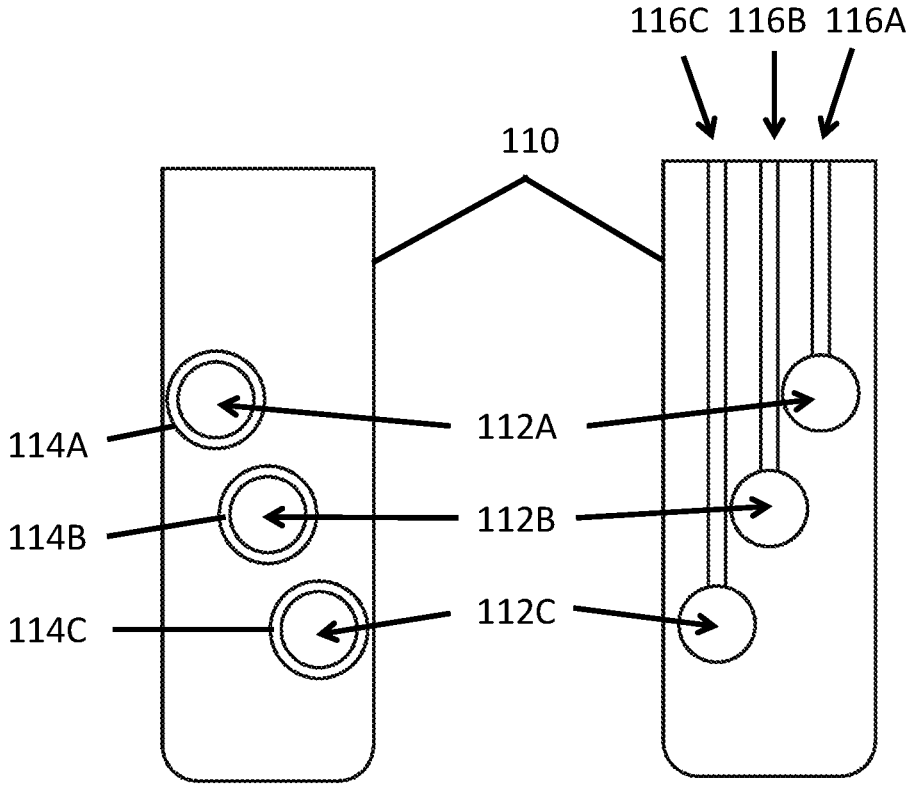
FIG. 5B is a top view of the accessory body of FIG. 5A.
FIG. 5C is a bottom view of the accessory body of FIG. 5A.

FIG. 3 is a bottom view of the device 100 with the mounting material 170 removed. The adjustment rods 150 slide within slots or channels 116A, 116B, 116C (FIGS. 5A and 5C) to vary the height of the dampeners 130A, 130B, 130C within vertical openings 112A, 112B, 112C (FIG. 5A) through the body 110. Each adjustment rod 150 includes a shaft 152 with an angled inner end 154 and a handle 156 at the outer end (FIG. 4), allowing the user to grip the handle 156 to slide the adjustment rod 150 inwardly or outwardly relative to the corresponding dampener 130. The angle of the inner end 154 may be approximately 30°. As illustrated in FIGS. 5A and 5B, each opening 112A, 112B, 112C (collectively 112) is counter-sunk 114A, 114B, 114C (collectively 114) to allow each respective dampener 130 to fit securely inside the opening 112 without falling through the bottom. The grooves 116A, 116B, 116C are approximately 1.258 inches, 2.008 inches, and 2.758 inches long, respectively, and the corresponding adjustment rods 150A, 150B, 150C are somewhat longer and approximately 0.125 inches square in cross-section. In addition to securing the device 100 to the surface of the guitar, the mounting material 170 covers the open channels 116 to retain the adjustment rods 150 within the channels 116.

Figure 6A:
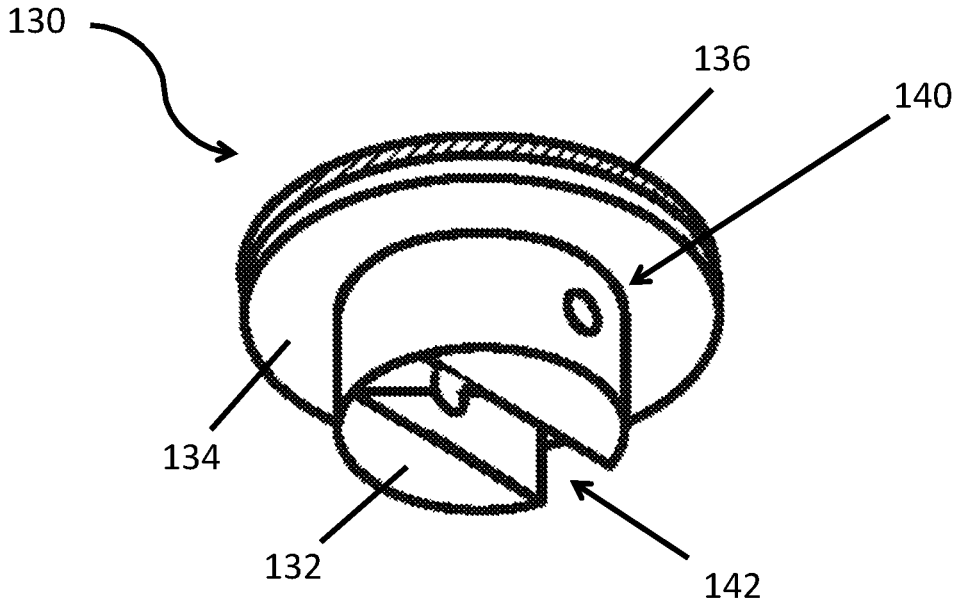
FIG. 6A is bottom perspective view of an embodiment of a dampener used with the accessory of FIG. 1.
Figure 6B:
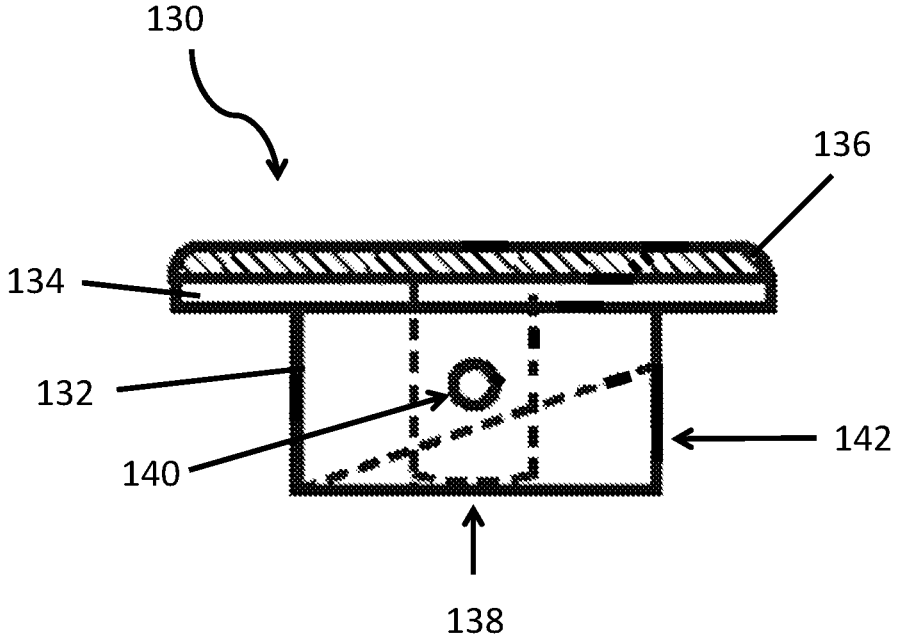
FIG. 6B is a side cut-cross-sectional view of the dampener of FIG. 6A.
Figure 6C:
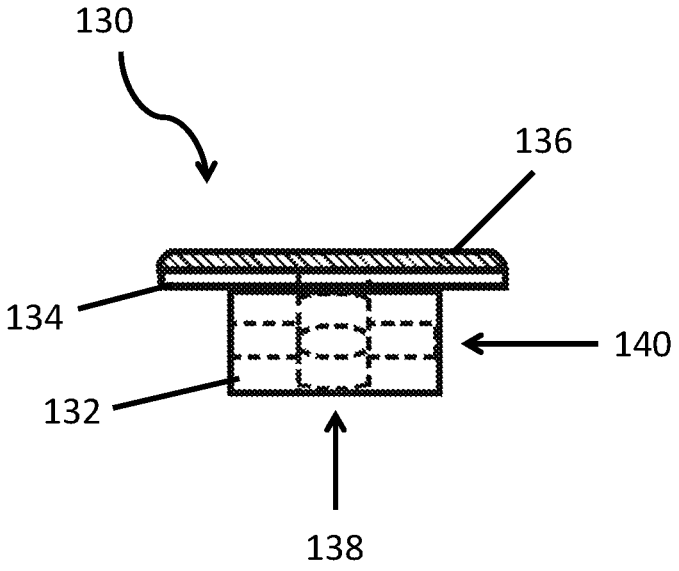
FIG. 6C is a front cross-sectional view of the dampener of FIG. 6A.
Figure 6D:
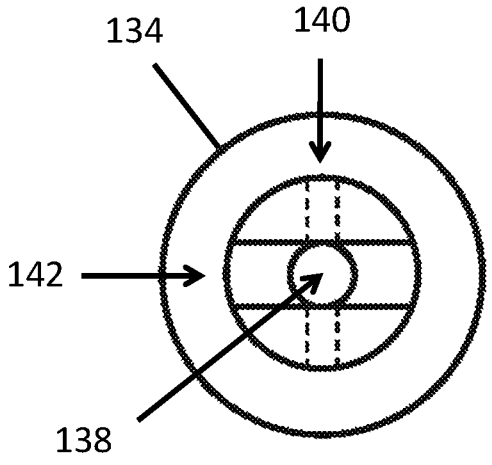
FIG. 6D is a bottom view of the dampener of FIG. 6A.
Figure 6E:
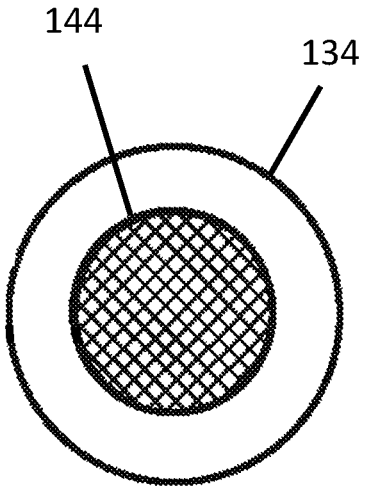
FIG. 6E is a top view of the dampener of FIG. 6A with the fabric cover removed.

Each dampener 130 includes a body 132 that fits within the opening 112, a lip 134 around the top surface of the body 132 that sits in the counter-sunk area 114, and a soft fabric pad 136 that touches the strings of the guitar 10. A hole 138 may be formed vertically through the center of the body 132 and a smaller hole 140 may be formed horizontally through the body 132. Additionally, an angled groove 142 is formed in the bottom of the body 132 having an angle, such as approximately 30°, that matches the angle of the inner end 154 of the adjustment rod 150. FIG. 6C is a front cross-sectional view of the dampener 130 and FIG. 6D is a bottom view of the dampener 130. FIG. 6E is a top view of the dampener 130 with the fabric pad 136 removed to expose a weight, such as a magnet 144 that preferably generates a magnetic attraction with the ferromagnetic adjustment rod 150.

Although in the embodiment described and illustrated herein the openings 112 are circular and the dampeners 130 are cylindrical, the present invention is not limited to such shapes and the openings 112 are circular and the dampeners 130 may have other shapes. In one embodiment, each opening 112 through the body 110 of the device 100 is approximately 0.5 inches in diameter and each counter-sink 114 is approximately 0.0625 inches deep. The body 132 of the dampener 130 is approximately 0.375 inches in diameter and approximately 0.219 inches high. The lip 134 is approximately 0.625 inches in diameter and approximately 0.0365 inches thick. The dampener body 132 and lip 134 may be made of any of the same materials as the body 110. The fabric pad 136 may be any soft material, such as felt or Velcro®.

As noted above with reference to FIG. 2, the device 100 may be slid under the strings of the guitar 10 (or other stringed instrument) near the bridge and secured by pressing down on the device 100 to allow the mounting material 170 to adhere to the surface of the guitar 10. The mounting material 170 may be any appropriate material that allows the device 100 to stick to the surface of the guitar 10 but also allows the device to be easily removed without harming the surface of the guitar 10. Such material 170 may include, for example, micro-suction tape, removable tape, and any temporary bonding adhesive.

Figure 7A:
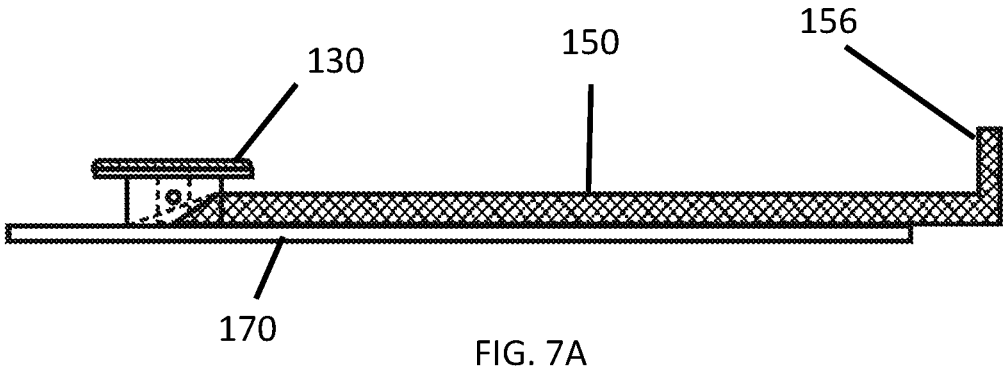
FIG. 7A is a side view of the accessory of FIG. 1.
Figure 7B:
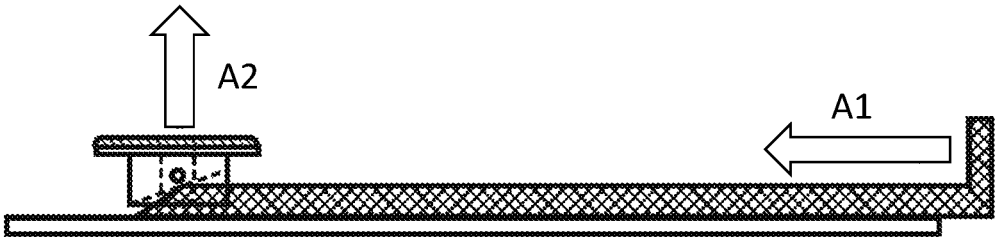
FIG. 7B is second side view of the accessory of FIG. 1 illustrating a first tuning action.
Figure 7C:
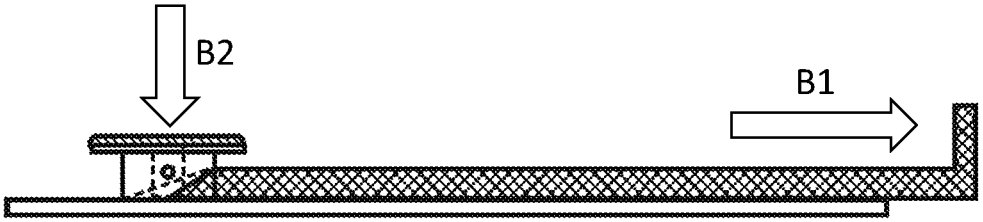
FIG. 7C is third side view of the accessory of FIG. 1 illustrating a second tuning action.

After the device 100 has been secured, the adjusting rods 150 may be used to change the height of each dampener 130 which changes the pressure of each dampener 130 against the corresponding pair of strings, altering the timbre of the strings. FIG. 7A is a side view of the device 100 with the body 110 removed and illustrates the adjustment rod 150 engaged within the angled groove 142 of the dampener 130. When the adjustment rod 150 is pushed in (arrow A1, FIG. 7B) and presses against the inside of the angled groove 142, the dampener 130 is raised (arrow A2). Similarly, when the adjustment rod 150 is pulled out (arrow B1, FIG. 7C) and moves away from the inside of the angled groove 142, the dampener 130 is lowered (arrow B2). The adjustment rods 150 are moved until the dampeners 130 apply the desired amount of pressure to the respective strings to produce the chosen sound from the guitar 10, such as a banjo sound. It will be appreciated that the adjustment rods 150 and the corresponding channels 116 may be threaded for a more precise adjustment of the height of the dampeners 130 and to maintain a consistent pressure by reducing any slippage of the adjustment rods 150 within the channels 116.

It will be understood that there is a sliding scale of pressure that can be applied to the strings using the fabric 136 to give the guitar 10 a banjo sound, and it is based on the user's preference. As the dampeners 130 are raised so that the fabric 136 begins to touch the strings, the strings are lightly dampened, which creates a small amount of "twang" when the strings are strummed or picked. As the dampener 130 is raised more and more, causing more pressure against the strings, more of a "twang" is created. However, the sustain of the note is less than if the fabric 136 was only lightly touching the strings, or not touching the strings at all. Finally, If the dampener 130 is raised to apply the maximum pressure, the note does not sound at all. Therefore, to reach the desired sound on any given pair of strings, the user has to find the amount of pressure that produces both the desired "twang" and desired sustain. Once the user finds the desired amounts of pressure applied to each pair of strings, the strings may be strummed or picked with bare fingers or with finger picks to play their guitar and imitate the sound of a banjo.

As previously noted, the device 100 may be adapted to change the timbre of any stringed instrument.

The description of the present invention has been presented for purposes of illustration and description, but is not intended to be exhaustive or limited to the invention in the form disclosed. Many modifications and variations will be apparent to those of ordinary skill in the art. For example, as previously noted, the device 100 may be adapted to change the timbre of any stringed instrument, electric or acoustic. The embodiment was chosen and described in order to best explain the principles of the invention, the practical application, and to enable others of ordinary skill in the art to understand the invention for various embodiments with various modifications as are suited to the particular use contemplated.

What is claimed is:

1. An attachable accessory for changing the timbre of a stringed instrument, comprising:

a body having a first vertical opening formed from a top surface through to a bottom surface and further having a first horizontal slot formed in the bottom surface from one edge of the body into the first vertical opening, the bottom surface being attachable to a stringed instrument under a first string;

a first adjustment rod within the first horizontal slot, comprising:

a handle at an outer end extending outside the first slot; and an upwardly angled inner end within the first vertical opening in the body;

a first dampener within the first vertical opening and associated with the first string of the stringed instrument to which the accessory is attached, the first dampener comprising:

a first dampener body;

a soft fabric covering a top surface of the first dampener body; and a bottom surface having a horizontal groove with a downwardly angled top surface, the angle of the groove corresponding to the angle of the first adjustment rod;

wherein:

when the first adjustment rod is pushed inwardly, the first dampener moves upward in the first vertical opening whereby the soft fabric applies pressure to the first string of the instrument; and when the first adjustment rod is pulled outwardly, the first dampener moves downward in the first vertical opening whereby the pressure on the first string is reduced.

2. The accessory of claim 1, wherein:

the first vertical opening through the body has a counter-sunk area at the top surface of the body; and the first dampener body comprises a lip around the top surface configured to fit into the counter-sunk area.

3. The accessory of claim 2, wherein:

the first vertical opening through the body is circular; and the first dampener body has a cylindrical shape.

4. The accessory of claim 1, wherein:

the first adjustment rod comprises a ferromagnetic material; and the first dampener further comprises a magnet in magnetic association with the adjustment rod.

5. The accessory of claim 1, wherein:

the body of the device comprises a plurality of first vertical openings and a like plurality of first horizontal slots; and the accessory further comprises:

a like plurality of first adjustment rods, each within an associated first horizontal slot; and a like plurality of first dampeners, each within an associated vertical opening in the body and each associated with at least one corresponding string of the stringed instrument;

wherein:

when each first adjustment rod is moved inwardly, the associated first dampener moves upward in the associated first vertical opening whereby the soft fabric applies pressure to the at least one first string of the instrument; and when each first adjustment rod is moved outwardly, the associated first dampener moves downward in the associated first vertical opening whereby the pressure on the at least one first string is reduced.

6. The accessory of claim 5, wherein the plurality is three.

7. The accessory of claim 5, wherein:

the body has a rectangular shape;

the plurality of first vertical openings are at staggered distances from an end of the body;

the plurality of first horizontal slots have lengths that correspond to the staggered distances of the first vertical openings; and the plurality of adjustment rods have lengths that correspond to the staggered distances of the first vertical openings.

8. The accessory of claim 1, wherein the bottom surface of the body comprises a mounting material with which the accessory is attachable to the surface of the stringed instrument.

9. The accessory of claim 8, wherein the mounting material is selected from the group consisting of a removable tape, a micro-suction tape, and a temporary bonding material.

10. An attachable accessory for changing the timbre of a stringed instrument, comprising a body having a vertical opening formed from a top surface through to a bottom surface and further having a horizontal slot formed in the bottom surface from one edge of the body into the vertical opening, the bottom surface being attachable to a stringed instrument under a string;

an adjustment rod within the horizontal slot, comprising:

a handle at an outer end extending outside the slot; and an upwardly angled inner end within the vertical opening in the body;

a dampener within the vertical opening and associated with the string of the stringed instrument to which the accessory is attached, the dampener comprising:

a dampener body;

a soft fabric covering a top surface of the dampener body; and a bottom surface having a horizontal groove with a downwardly angled top surface, the angle of the groove corresponding to the angle of the adjustment rod;

wherein:

when the adjustment rod is pushed inwardly, the dampener moves upward in the vertical opening whereby the soft fabric applies pressure to the string of the instrument; and when the adjustment rod is pulled outwardly, the dampener moves downward in the vertical opening whereby the pressure on the string is reduced.

11. The accessory of claim 10, wherein:

the vertical opening through the body has a counter-sunk area at the top surface of the body; and the dampener body comprises a lip around the top surface configured to fit into the counter-sunk area.

12. The accessory of claim 11, wherein:

the vertical opening through the body is circular; and the dampener body has a cylindrical shape.

13. The accessory of claim 10, wherein:

the body of the device comprises a plurality of vertical openings and a like plurality of horizontal slots; and the accessory further comprises:

a plurality of first adjustment rods, each within an associated horizontal slot; and a like plurality of dampeners, each within an associated vertical opening in the body and each associated with at least one corresponding string of the stringed instrument;

wherein:

when each adjustment rod is moved inwardly, the associated dampener moves upward in the associated vertical opening whereby the soft fabric applies pressure to the corresponding string of the instrument; and when each adjustment rod is moved outwardly, the associated dampener moves downward in the associated vertical opening whereby the pressure on the corresponding string is reduced.

14. The accessory of claim 13, wherein the plurality is three.

15. The accessory of claim 13, wherein:

the body has a rectangular shape;

the plurality of vertical openings are at staggered distances from an end of the body;

the plurality of horizontal slots have lengths that correspond to the staggered distances of the vertical openings; and the plurality of adjustment rods have lengths that correspond to the staggered distances of the vertical openings.

16. The accessory of claim 10, wherein the bottom surface of the body comprises a mounting material with which the accessory is attachable to the surface of the stringed instrument.

17. A method for changing the timbre of a stringed instrument, comprising:

attaching a bottom surface of an accessory body to a stringed instrument under the strings, the accessory body having a plurality of dampeners and a like plurality of adjustment rods, each dampener associated with at least one string and each adjustment rod associated with a corresponding one of the plurality of dampeners;

moving an adjustment rod inwardly to move the associated dampener upward to increase pressure against the at least one associated string; and moving the adjustment rod outwardly to move the associated dampener downward to decrease the pressure against the at least one associated string, wherein the stringed instrument has six strings and the plurality of dampeners is three, and wherein:

moving each adjustment rod inwardly increases pressure against two associated strings; and moving each adjustment rod outwardly decreases pressure against the two associated strings.

* * * * *